US006659781B2

(12) United States Patent
Miyazaki

(10) Patent No.: US 6,659,781 B2
(45) Date of Patent: Dec. 9, 2003

(54) SHIELD CONNECTOR FOR EQUIPMENT

(75) Inventor: Sho Miyazaki, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 23 days.

(21) Appl. No.: 10/133,750

(22) Filed: Apr. 29, 2002

(65) Prior Publication Data

US 2002/0168884 A1 Nov. 14, 2002

(30) Foreign Application Priority Data

May 8, 2001 (JP) ..... 2001-137044

(51) Int. Cl.[7] ..... H01R 4/66
(52) U.S. Cl. ..... 439/98; 439/582; 439/610
(58) Field of Search ..... 439/92, 98, 582, 439/939, 610, 108; 174/65 R

(56) References Cited

U.S. PATENT DOCUMENTS 6,053,749 A 4/2000 Masuda et al. ..... 439/98
6,358,069 B2 * 3/2002 Yoshioka et al. ..... 439/108

* cited by examiner

*Primary Examiner*—Michael C. Zarroli
(74) *Attorney, Agent, or Firm*—Oliff & Berridge, PLC

(57) ABSTRACT

Mounting members 36 produced separately from holders 26 are fitted with the outer surfaces of the holders 26. The holders 26 respectively include projecting portions 31 formed in the outer peripheries thereof and the mounting members 36 respectively include recessed portions 38 formed in the inner peripheries of fit holes 37 opened up therein. The projecting portions 31 and recessed portions 38 allow the mounting members 36 to be positioned with respect to the holders 26 in an arbitrary one of a plurality of mounting positions of the holders 26 respectively set in the peripheral direction thereof.

3 Claims, 5 Drawing Sheets

SHIELD CONNECTOR FOR EQUIPMENT

BACKGROUND OF THE INVENTION

The present invention relates to a shield connector for equipment.

Conventionally, for a shield connector for equipment which is used to connect a plurality of electric wires to an inverter apparatus disposed in an electric car, there is available a structure in which a plurality of connecting holes are opened up in a conductive shield case, a plurality of equipment-side terminals fixed to an inverter apparatus are disposed so as to correspond to the connecting holes of the shield case, wire-side terminals respectively fixed to their associated ones of the electric wires are individually inserted into the connecting holes and are thereby connected to the equipment-side terminals, the plurality of wires are collectively enclosed by a tube-shaped shield member, and a shield shell fixed to the end portion of the shield member is connected to the shield case.

In the conventional connector of this collective-shield type, to insert the plurality of wire-side terminals individually into their associated connecting holes to thereby connect the wire-side terminals to the equipment-side terminals, there is necessary such means as can prevent the wire-side and equipment-side terminals from being connected together in a wrong combination.

Conventionally, as the wrong connection preventive means, there is proposed means in which holders each having a mounting portion formed integrally and projectingly in the outer periphery thereof are respectively fitted with the outer surfaces of the wire-side terminals by resin molding. According to the present wrong connection preventive means, in case where the positions of the mounting portions in the peripheral direction of the holders are set different from one another between the holders, the wrong connection can be prevented.

However, as in the above-mentioned conventional shield connector manufacturing method in which the holder and its associated mounting portion are molded as an integral unit using a single metal mold, as the metal molds for resin molding, there are necessary metal molds equal in number to the poles of a terminal. Here, in an electric car, the number of terminal poles must be three or more and, therefore, there are necessary three or more kinds of metal molds. This raises a problem that the costs of the metal molds are high.

SUMMARY OF THE INVENTION

The present invention aims at eliminating the drawbacks found in the conventional shield connector for equipment. Accordingly, it is an object of the invention which can reduce the costs of metal molds.

In attaining the above object, according to a first aspect of the invention, there is provided a shield connector for equipment including a shield case for enclosing a plurality of equipment-side terminals, the shield case having a plurality of connecting holes corresponding to the equipment-side terminals and fixing portions accompanying the connecting holes, the shield connector for equipment comprising: a shield member for enclosing a plurality of wires collectively; a shield shell fixed to the end portion of the shield member and mountable onto the shield case; a plurality of wire-side terminals fixed individually to the end portions of the plurality of wires and connectable to the equipment-side terminals; and, a plurality of holders fitted individually with the outer surfaces of the wire-side terminals by resin molding, fittable with the connecting holes, and including mounting means provided on and projected from the outer periphery thereof, the present mounting means being mountable onto the fixing portions, wherein the positions of the mounting means of the holders in the peripheral direction thereof are set different from one another between the holders, thereby preventing the wire-side terminals and equipment-side terminals from being connected together in wrong combinations, characterized in that the holders and mounting means are molded as separate parts and the mounting means can be fitted with the outer surfaces of the holders, and also that, in the outer peripheries of the holders and in the inner peripheries of the mounting means, there are disposed positioning means capable of positioning the mounting means with respect to the holders at an arbitrary one of a plurality of mounting positions respectively set in the peripheral direction of the holders.

Also, according to a second aspect of the invention, in a shield connector as set forth in the first aspect of the invention, the positioning means include a plurality of projecting portions formed in one of the outer peripheries of the holders and the inner peripheries of the mounting means and a plurality of recessed portions formed in the other.

Further, according to a third aspect of the invention, in a shield connector as set forth in the first or second aspect of the invention, in each of the outer peripheries of the holders, there are disposed not only a stopper, when contacted with the mounting means fitted with the outer surface of the holder up to a proper fit position in the axial direction thereof, for preventing the mounting means from moving any further, but also a removal preventive projection allowing the mounting means to be fitted therewith up to the proper fit position while it is elastically flexing so as to increase in diameter and, at the proper fit position, securing the mounting means thereto to thereby prevent the mounting means from moving any further in the removing direction thereof.

(First Aspect)

Since the mounting means can be positioned with respect to the holders at anyone of a plurality of positions respectively set in the peripheral direction of the holders, in case where the peripheral-direction positions of the mounting means are set different from one another between the holders, wrong connection between the equipment- and wire-side terminals (which means that the holders are fitted with the wrong or incorrect connecting holes) can be prevented. According to the first aspect of the invention, because the holders and mounting means can be respectively formed as common parts, as metal molds for molding a shield connector for equipment according to the first aspect of the invention, there are necessary only two kinds of metal molds: that is, one for resin molding the holders and the other for molding the mounting means.

(Second Aspect)

In case where any one of the plurality of recessed portions is fitted with the projecting portion, the mounting means can be positioned with respect to the holder. The mutual engagement between the projecting portions and recessed portions is able to prevent the mounting means from playing with respect to the holders in the peripheral direction thereof, thereby being able to secure high reliability in the positioning of the mounting means.

(Third Aspect)

In the process for fitting the mounting means with the holder, the mounting means is allowed to be fitted with the removal preventive projection while it is elastically flexing so as to increase in diameter and reach its proper fit position and, when the mounting means reaches the proper fit position, the engagement between the stopper and removal preventive projection can prevent the mounting means against play with respect to the holder in the axial direction thereof.

Figure 1:
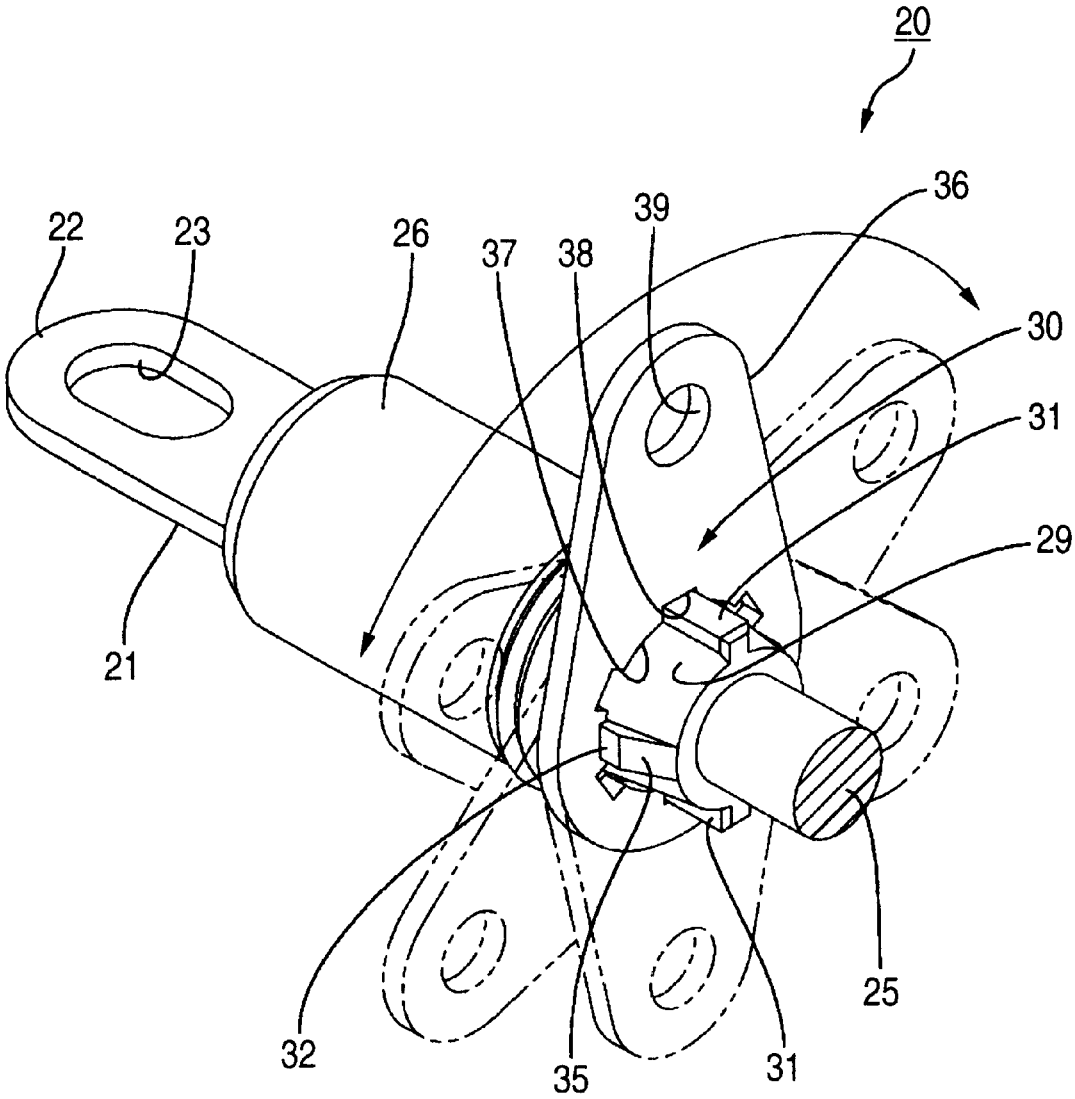
FIG. 1 is a perspective view of an embodiment 1 of a shield connector for equipment according to the invention.
Figure 2:
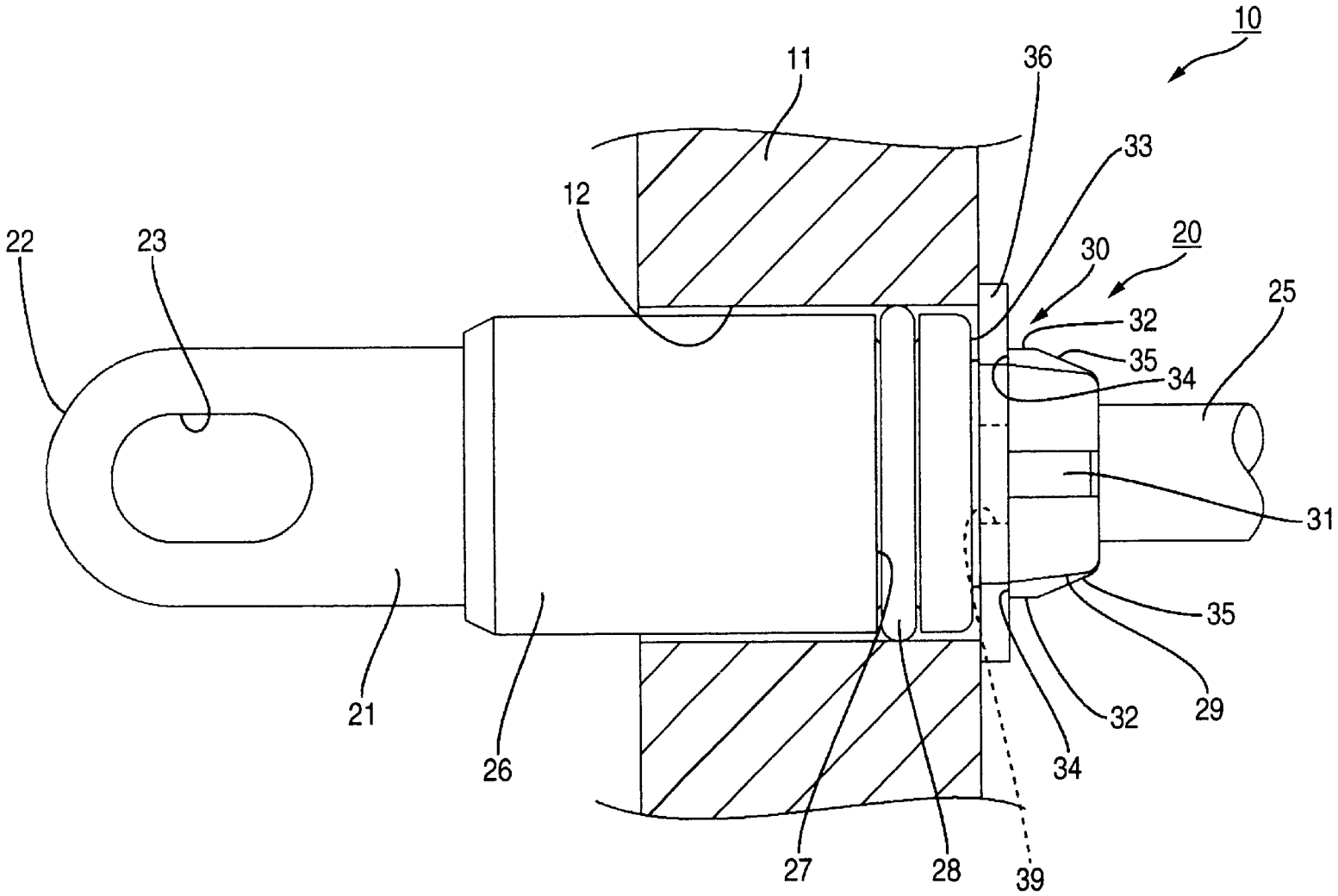
FIG. 2 is a partially cutaway plan view of the embodiment 1, showing a state thereof in which it is mounted on an inverter apparatus.
Figure 3:
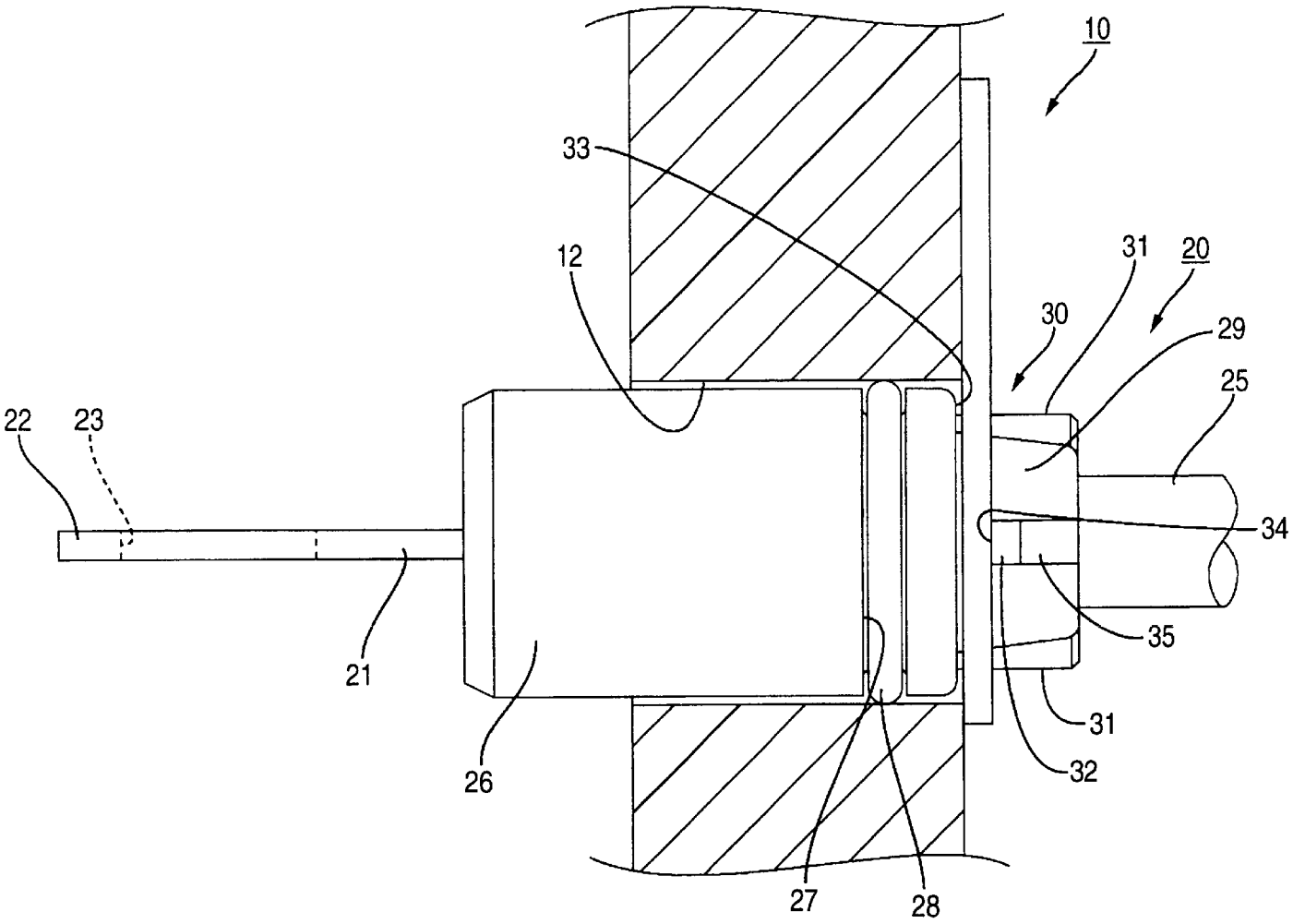
FIG. 3 is a partially cutaway side view of the embodiment 1, showing a state thereof in which it is mounted on the inverter apparatus.
Figure 4:
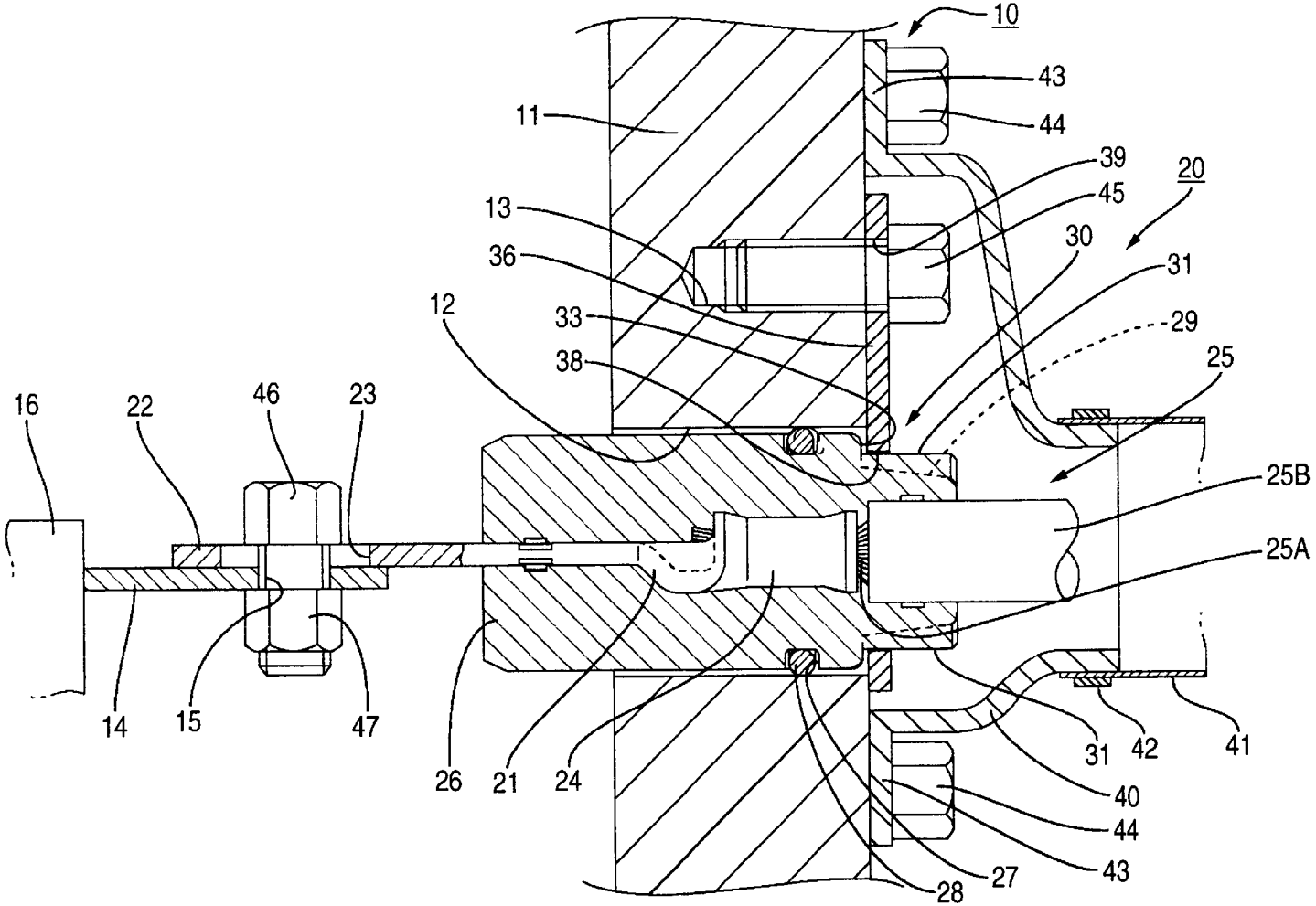
FIG. 4 is a longitudinal section view of the embodiment 1, showing a state thereof in which it is mounted on the inverter apparatus; and, FIG. 5 is a longitudinal section view of the embodiment 1, showing a state thereof in which it is mounted on equipment.

DETAILED DESCRIPTION OF THE PREFERRED EMBODIMENTS (Embodiment 1)

Now, description will be given below of an embodiment 1 of a shield connector for equipment according to the invention with reference to FIGS. 1 to 5.

A shield connector for equipment 20 according to the present embodiment is mounted into an inverter apparatus 10 (equipment which is a composing element of the invention) provided in an electric car. The inverter apparatus 10 is structured such that an inverter main body 16 is stored in the interior of a conductive shield case 11. In the side wall of the shield case 11, there are formed three circular-shaped connecting holes 12 in such a manner that they are arranged side by side in the right and left direction (in the horizontal direction) and, at the same time, there are formed three female screw holes 13 (fixing portions which provide a composing element of the invention) which respectively accompany the connecting holes 12 and have a dead-end shape (a shape which is not opened in the inner surface of the shield case 11). In the interior of the shield case 11, there are disposed three equipment-side terminals 14 which are fixed to the inverter main body 16 in such a manner that their leading end portions with bolt holes 15 formed therein are opposed to their respective connecting holes 12. Each of the three equipment-side terminals 14 includes a high-rigidity bus bar made of a thick metal plate and, in a state where it is fixed to the inverter main body, the plate surface thereof faces in the horizontal direction and thus the bolt hole 15 penetrates in the vertical direction.

The shield connector for equipment 20 comprises three wire-side terminals 21, three holders 26, three mounting members 36 (that is, mounting means which is a composing element of the invention), and a shield shell 40. Each of the wire-side terminals 21, similarly to the equipment-side terminals 4, includes a high-rigidity bus bar made of a thick metal plate; and, the wire-side terminal 21 is long and narrow in the back-and-forth direction thereof as a whole. In the front-end connecting portion 22 of the wire-side terminal 21, there is formed a bolt hole 23 having a rectangular shape long in the back-and-forth direction and, in the rear end portion thereof, there is formed a wire connecting portion 24 which has an open barrel shape. To the wire connecting portion 24, there is fixed the extension end portion of a wire 25 which is extended from a motor (not shown) of a wheel and does not have a shield function. The wire 25 is structured such that a conductor 25A including a plurality of metal lines twisted together is covered with an insulating cover 25B made of resin; and, in the extension end portion of the wire 25, the insulating cover 25B is removed therefrom to expose the conductor 25A, while the thus exposed conductor 25A is pressure contacted with the wire connecting portion 24.

With the outer surfaces of the thus structured three wire-side terminals 21, there are fitted their associated holders 26 individually. That is, in the case of the wire-side terminals 21, the wire connecting portion 24 of the wire-side terminal 21 and the end portion of the wire 25 pressure contacted with the wire connecting portion 24 are set within a metal mold (not shown) for molding the holder 26, and the wire-side terminal 21 and its associated holder 26 are resin molded together into an integral unit within the metal mold. From the front end face of the holder 26 so fixed by resin molding to the wire-side terminal 21 as to enclose the wire connecting portion 24 thereof, there is projected the connecting portion 22 of the wire side terminal 21 with the bolt hole 23 formed therein in such a manner that the plate surface of the connecting portion 22 faces in the horizontal direction (a posture in which the bolt hole 23 penetrates in the vertical direction). Also, the holder 26 has a shape to be able to cover the exposed end portion of the conductor 25A (which includes the portion thereof pressure contacted with the wire connecting portion 24 and the exposed portion thereof exposed to the two front and rear sides of the wire connecting portion 24), while the holder 26 is closely contacted in a liquid tight manner with the outer surface of the plate-shaped portion of the wire side terminal 21 that is situated forwardly of the wire connecting portion 24. Also, from the rear end face of the holder 26, there is guided the portion of the wire 25 that is covered with the insulating cover 25B.

The thus structured holder 26 has a cylindrical shape the axis of which faces in the back-and-forth direction thereof (in the longitudinal direction of the end portion of the wire 25 to be pressure contacted with the wire connecting portion 24) and, in a seal groove 27 formed in the outer periphery of the holder 26, there is mounted a seal ring 28. The positions of the seal groove 27 and seal ring 28 are so set in the longitudinal direction of the holder 26 as to correspond to the wire connecting portion 24.

Also, in the rear end portion of the holder 26, there is formed a tapered diameter-reducing portion 29 concentrically with the holder 26, while the diameter-reducing portion 29 not only reduces in diameter in a stepped manner but also gradually reduces in diameter as it goes in the backward direction. In the outer periphery of the diameter-reducing portion 29, there are disposed not only a pair of upper and lower projecting portions 31 with a clearance of 180° between them in the peripheral direction of the diameter-reducing portion 29, but also a pair of right and left removal preventive projections 32 which are respectively shifted by 90° in phase in the peripheral direction of the diameter-reducing portion 29 with respect to the two projecting portions 31. The projecting portions 31 extend in the back-and-forth direction (in the direction which is parallel to the fitting direction of the mounting member 36 with respect to the holder 26), while the formation range of the projecting portions 31 extends from the rear end of the diameter-reducing portion 29 up to a stopper 33 disposed on the front end of the diameter-reducing portion 29. Also, the formation range of the removal preventive projections 32 extends from the rear end of the diameter-reducing portion 29 up to a position slightly backwardly of the stopper 33, a clearance between the front end of the removal preventive projections 32 and the stopper 33 in the back-and-forth direction is set equal to or slightly larger than the plate thickness of the removal preventive projection 32. Further, the front end face of the removal preventive projection 32 is formed so as to provide a securing surface 34 which is opposed to the stopper 33, while the substantially half section of the outer surface of the removal preventive projection 32 is formed so as to provide an inclined guide surface 35 which is inclined such that it approaches the central side thereof in the diameter direction thereof as it goes in the backward direction.

The mounting member 36 is made of synthetic resin and is molded as a separate part from the holder 26 using a metal mold in such a manner that it has a water-drop-like plate shape as a whole. In the mounting member 36, there is formed a circular-shaped fit hole 37 having an inside diameter equal to or slightly larger than the maximum outside diameter of the diameter-reducing portion 29. In the inner periphery of the fit hole 37, there are formed six recessed portions 38 at regular intervals of an equal angle of 60° in the peripheral direction of the fit hole 37. The recessed portions 38 cooperate together with the projecting portions 31 of the holder 26 in forming positioning means 30, while the projecting portions 31 can be fitted with any one of the six recessed portions 38 in the peripheral direction with no play with respect to the recessed portions 38. Also, in the mounting member 36, there is included a bolt hole 39 which is formed spaced apart from the fit hole 37.

Figure 5:
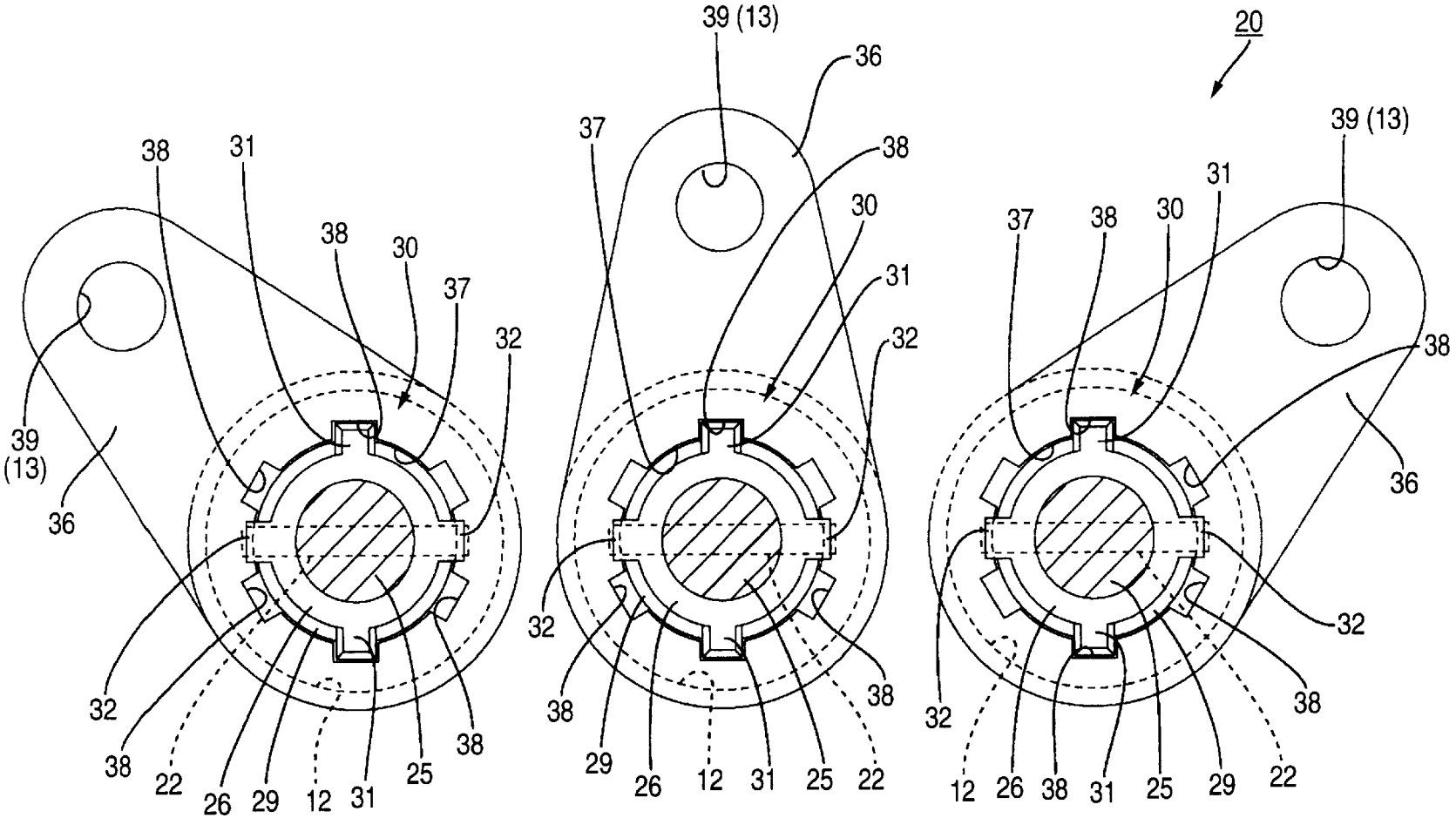

On the other hand, the positional relations of the connecting holes 12 formed in the outer surface of the shield case 11 with respect to the female screw holes 13 disposed so as to accompany the respective connecting holes 12 differ from one another between the three connecting holes 12. That is, as shown in FIG. 5, the female screw hole 13 accompanying the central connecting hole 12 is situated just above the present connecting hole 12. The female screw hole 13 accompanying the left connecting hole 12 is situated at a position inclined by an angle of 60° (which equal to the angle of the recessed portion 38) to the left with respect to the direction just above the present connecting hole 12. And, the female screw hole 13 accompanying the right connecting hole 12 is situated at a position inclined by an angle of 60° to the right with respect to the direction just above the present connecting hole 12. Also, the distances between the centers of the respective connecting holes 12 and the centers of their associated female screw holes 13 are all the same in all of the connecting holes 12, while the present distance is equal to the distance between the center of the fit hole 37 and the center of the bolt hole 39 of the mounting member 36.

The shield shell 40 is connected to the end portion of a cylindrical-shaped shield member 41 which encloses the three wires 25 collectively, while the shield shell 40 is formed in a cylindrical shape as a whole. With the outer surface of the outer periphery of the rear end portion of the shield shell 40, there is fitted the end portion of the shield member 41; a caulking ring 42 is fitted with the outer surface of the shield member 41; and, the caulking ring 42 is caulked to the outer periphery of the shield shell 40, whereby the shield shell 40 and shield member 41 are fixed to each other. Also, in the shield shell 40, there is formed a mounting portion 43 which projects up and down from the opening edge of the shield shell 40 existing on the front end side thereof. In case where the mounting portion 43 is threadedly engaged into a female screw hole (not shown) formed in the outer surface of the shield case 11, the mounting portion 43 can be conductively fixed to the shield case 11.

Next, description will be given below of the operation of the present embodiment.

The wire-side terminals 21 and the holders 26 respectively formed integral with their associated wire-side terminals 21 are all formed by molding using the same metal mold, while the directions of the connecting portions 22 and bolt holes 23 formed in the peripheral direction of the wire-side terminals 21 and the directions of the projecting portions 31 of the holders 26 are all set in the same direction. While the wires 25 are previously inserted into the fit holes 37, the three mounting members 36 are respectively fitted with the outer surfaces of their associated holders 26 from behind.

In the present outer-surface fitting process, the inner peripheries of the fit holes 37 of the mounting members 37 are slidingly contacted with the inclined guide surfaces 35 of the removal preventive projections 32 and, due to the inclined shape of the guide surfaces 35, the mounting members 36 are elastically flexed in such a manner that the fit holes 37 are partially enlarged in diameter. And, in case where the mounting members 36 are fitted up to the proper outer-surface fit positions, the front surfaces of the mounting members 36 are contacted with the stoppers 33, so that any further movements of the mounting members 36 in the fitting direction (in the forward direction) can be prevented. At the same time, the mounting members 36 are elastically returned in such a manner that the fit holes 37 are reduced in diameter and the hole edges of the fit holes 37 are secured to the securing surfaces 34 of the removal preventive projections 32, thereby being able to prevent the mounting members 36 from playing in the backward direction (in the removing direction). Due to this, the mounting members 36 can be mounted onto the holders 26 in such a manner that they are prevented against play in the back-and-forth direction.

Also, when fitting the mounting members 36 with the outer surfaces of the holders 26, of the six recessed portions 38 formed in each of the mounting member 36, two recessed portion 38 are fitted with the pair of upper and lower projecting portions 31 respectively. Due to the fitting engagement between the projecting portions 31 and recessed portions 38, the play of the mounting members 36 with respect to the holders 26 can be prevented.

Here, in the case of the holder 26 to be fitted with the central connecting hole 12, the mounting member 36 is set in such a direction that the bolt hole 39 of the present mounting member 36 is situated just above its associated fit hole 37. Also, for the holder 26 to be fitted with the left connecting hole 12, the mounting member 36 is set in such a direction that the bolt hole 39 of the present mounting member 36 is situated at a position inclined by an angle of 60° to the left from the position just above its associated fit hole 37. And, for the holder 26 to be fitted with the right connecting hole 12, the mounting member 36 is set in such a direction that the bolt hole 39 of the present mounting member 36 is situated at a position inclined by an angle of 60° to the right from the position just above its associated fit hole 37.

In this manner, the three mounting members 36 are fitted with the outer surfaces of their associated holders 26 in such a manner that they are different from one another in the facing directions in the peripheral direction thereof. After then, the three holders 26 are respectively fitted with their given connecting holes 12. In case where the holders 26 are fitted with the correct connecting holes 12 respectively, not only the bolt holes 39 of the mounting members 36 correspond coaxially to the female screw holes 13 of the shield case 11, but also the connecting portions 22 of the wire-side terminals 21 on the front end side thereof are set to face horizontally and are superimposed on the upper surfaces of the equipment-side terminals 14, so that the bolt holes 23 of the wire-side terminals 21 are allowed to correspond to the bolt holes 15 of the equipment-side terminals 14. Therefore, in this case, in case where bolts 45 inserted into the bolt holes 39 are threadedly engaged with the female screw holes 13 respectively, the mounting members 36 can be fixed to the shield case 11; and, at the same time, in case where nuts 47 are threadedly engaged with bolts 46 inserted through the bolt holes 15, 23 of the wire- and equipment-side terminals 14, 21, the two kinds of terminals 14, 21 can be connected conductively.

In case where the holders 26 are fitted with the wrong connecting holes 12 which provide an incorrect combination, the connecting portions 22 of the wire-side terminals 21 are caused to take inclined postures and, therefore, halfway in the fitting operation, the connecting portions 22 are butted against the equipment-side terminals 14, which makes it impossible to fit the two terminals with each other. And, the positions of the bolt holes 39 of the mounting members 36 are also shifted from the positions of the female screw holes 13 of the shield case 11.

After the three holders 26 are all mounted onto the shield case 11 in the above-mentioned manner, the shield shell 40 is mounted onto the shield case 11. This completes the mounting of the shield connector 20 for equipment onto the inverter apparatus 10.

As described above, in the present embodiment, while the holders 26 and mounting members 36 are all formed as common parts, the mounting members 36 can be positioned with respect to the holders 26 at any arbitrary one of the six mounting positions in the peripheral direction of the holders 26. Therefore, in case where the peripheral-direction positions of the mounting members 36 are set different from one another between the three holders 26, the wrong connection between the equipment- and wire-side terminals can be prevented (that is, it is possible to prevent the holders 26 from being fitted with the wrong connecting holes 12 which provide an incorrect combination). That is, since the shapes of the holders 26 and mounting members 36 can be set as common shapes, as the metal molds for molding the shield connector 20, there can be used only two kinds of metal molds, that is, a metal mold for resin molding the holders 26 integrally with the wire-side terminals 21, and a metal mold for molding the mounting members 36, thereby being able to reduce the costs of the metal molds for manufacturing the shield connector for equipment 20.

(Other Embodiments)

The invention is not limited to the embodiment explained heretofore in the foregoing description with reference to the accompanying drawings but, for example, the following embodiments all fall within the technical scope of the invention. Further, other various changes and modifications than the following embodiments are also possible without departing from the scope of the appended patent aspects.

(1) In the illustrated embodiment, as the positioning means, there are formed the projecting portions in the outer peripheries of the respective holders as well as there are formed the recessed portions in the inner peripheries of the fit holes of the respective mounting members. However, according to the invention, the recessed portions may also be formed in the outer peripheries of the respective holders and the projecting portions may also be formed in the inner peripheries of the fit holes of the respective mounting members.

(2) In the illustrated embodiment, as the positioning means, the outer peripheries of the respective holders and the inner peripheries of the fit holes of the respective mounting members are formed circular, and the projecting and recessed portions are formed in the peripheral surfaces of the outer peripheries of the holders and in the peripheral surfaces of the inner peripheries of the fit holes of the respective mounting members. However, according to the invention, the outer peripheries of the respective holders and the inner peripheries of the fit holes of the respective mounting members may also be formed as regular polygons.

(3) In the illustrated embodiment, the plurality of mounting positions of the mounting members with respect to the holders are set at regular intervals of an equal angle. However, according to the invention, the plurality of mounting positions can also be set at irregular intervals.

(4) In the illustrated embodiment, as the means for preventing the mounting members from being removed from the holders, there is employed the means in which the removal preventive projections formed in the holders are secured to the hole edges of the fit holes of the mounting members. However, according to the invention, the holders may be pressure inserted into the fit holes and frictional resistance caused by the present pressure insertion may be used to prevent the removal of the mounting members from the holders.

(5) In the illustrated embodiment, description has been given of a shield connector for equipment which includes a waterproofing seal ring. However, this is not limitative but the invention can also apply to a non-waterproofing shield connector for equipment which does not include a waterproofing seal ring.

(6) In the illustrated embodiment, description has been given of a case in which an inverter apparatus for use in a car is equipment to which the present shield connector for equipment is to be connected. However, this is not limitative but the invention can also apply to a case in which the equipment to be connected by the present shield connector for equipment is other equipment than the inverter apparatus.

(7) In the illustrated embodiment, the mounting members are fitted with the holders from the rear side thereof. However, according to the invention, the mounting members may also be fitted with the holders from the front side thereof.

What is claimed is:

1. A shield connector for equipment including a shield case for enclosing a plurality of equipment-side terminals, said shield case having a plurality of connecting holes corresponding to said equipment-side terminals and fixing portions accompanying the connecting holes, said shield connector for equipment comprising:

a shield member for enclosing a plurality of wires collectively;

a shield shell fixed to the end portion of said shield member and mountable onto said shield case;

a plurality of wire-side terminals fixed individually to the end portions of said plurality of wires and connectable to said equipment-side terminals; and a plurality of holders fitted individually with the outer surfaces of said wire-side terminals by resin molding, fittable with said connecting holes, and including mounting means provided on and projected from the outer periphery thereof, said mounting means being mountable onto said fixing portions of said shield case, wherein the positions of said mounting means of said holders in the peripheral direction thereof are set different from one another between said holders, so as to prevent said wire-side terminals and said equipment-side terminals from being connected together in wrong combinations, said holders and said mounting means are molded as separate parts and said mounting means is capable to be fitted with the outer surfaces of said holders, and positioning means capable of positioning said mounting means with respect to said holders at an arbitrary one of a plurality of mounting positions respectively set in the peripheral direction of said holders, is disposed in the outer peripheries of said holders and in the inner peripheries of said mounting means.

2. The shield connector for equipment as set forth in claim 1, wherein said positioning means includes a plurality of projecting portions formed in one of the outer peripheries of said holders and in the inner peripheries of said mounting means, and a plurality of recessed portions formed in the other.

3. The shield connector for equipment as set forth in claim 1, further comprising:

in each of the outer peripheries of said holders, a stopper, when said mounting means fitted with the outer surface of said holder up to a proper fit position in the axial direction thereof is contacted with said stopper, for preventing said mounting means from moving any further, a removal preventive projection allowing said mounting means to be fitted therewith up to said proper fit position while said removal preventive projection is elastically flexing to increase in diameter and, at said proper fit position, securing said mounting means thereto to prevent said mounting means from moving any further in the removing direction thereof.

* * * * *